United States Patent [19]

Chen

[11] 4,419,193

[45] Dec. 6, 1983

[54] METHOD FOR MAKING HOLLOW PENDANTS

[76] Inventor: Juei-Lung Chen, Kaohsiung, Taiwan

[21] Appl. No.: 413,500

[22] Filed: Aug. 31, 1982

[51] Int. Cl.[3] ..... C25D 5/34; C25D 7/00

[52] U.S. Cl. ..... 204/18.1; 204/29

[58] Field of Search ..... 204/18.1, 29, 16, 25

[56] References Cited

U.S. PATENT DOCUMENTS 3,453,185 7/1969 Nakagawa ..... 204/18.1

3,886,051 5/1975 Albright ..... 204/18.1

*Primary Examiner*—T. M. Tufariello

*Attorney, Agent, or Firm*—Holman & Stern

[57] ABSTRACT

A method for making hollow pendants of copper plate without any holes therein so that electrolyte does not flow into the hollow of the pendants during electroplating. These hollow pendants can hold their beautiful surface a long time without being corroded by electrolyte solvent flowing into and slowly seeping out of the hollow parts of a pendant. Copper plate is cut and press-formed into half-pieces, two half-pieces are clamped together and welded tightly with silver, the hollow product undergoes grinding and polishing and is finally electroplated to complete the finished product with no holes. Consequently, its brilliant surface can not be spoiled by electrolyte solvent seeping out of any tiny holes.

2 Claims, 8 Drawing Figures

METHOD FOR MAKING HOLLOW PENDANTS

According to this new technical method, copper plate is to be cut and formed into half-piece of pendants by press, and two half-pieces—two half-pieces make a pendant—are held together with a clamp and then welded tightly with silver. Next, grinding and polishing makes this hollow pendant ready for electrolysis, after which the pendant becomes a finished product with no tiny holes on them. Consequently, its brilliant surface can not be spoiled by electrolyte solvent that could seep out of tiny holes, if there were any.

BACKGROUND OF THE INVENTION

1. Field of the Invention

This invention relates to a method for producing pendants which are hollow in construction.

2. Description of the Prior Art

Copper pendants were often made as solid articles, however cast copper might have a lot of tiny air holes inside and pendants made of cast copper will keep in these holes electrolyte solvent returned from the process of electroplating, which will slowly seep out and spoil the smooth surface of the pendants. Moreover, solid pendants may be a little too heavy to be practical for wearing.

In order to please consumers, pendants of copper plate instead of cast copper have been lately introduced by manufacturers in Hong Kong, Japan, and Taiwan. This kind of pendant is made up of two pieces of copper plate welded together so that its interior part is completely hollow. Because the welded part around the pendant can not be without any tiny holes, one little hole on the upper and another on the lower part of a pendant are opened so that electrolyte solvent which flows into the hollow part of a pendant can be forced out after the electroplating has been finished to avoid corrosion by the electrolyte solvent remaining inside. On the other hand, these two holes in a pendant may make it less beautiful.

BRIEF SUMMARY OF THE INVENTION

The invention overcomes the defects mentioned above by providing method for making a hollow pendant of copper plate which will keep its outward brilliance and smoothness for a long time. This method comprises forming half-pieces in the desired shape, joining two half-pieces together by welding and without producing holes therein, grinding, polishing and electroplating to produce the final article.

BRIEF DESCRIPTION OF DRAWINGS

In order that this invention can be clearly understood an embodiment thereof will be described by way of example with reference to the accompanying drawings wherein.

DESCRIPTION OF PREFERRED EMBODIMENT

Figure 1:
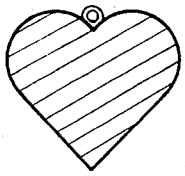
Prior Art Fig: 1
FIG. 1 is an elevational view of a conventional solid pendant of cast copper.
Figure 2:
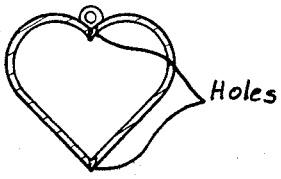
Prior Art Fig: 2
FIG. 2 is a cross-sectional view of conventional hollow pendant of copper plate with two holes.
Figure 3A:
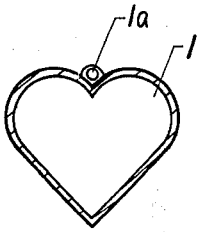
FIGS. 3*a* and 3*b* show an elevational and side view, respectively, of a half-piece of a pendant of copper plate in accordance with this invention.
Figure 3B:
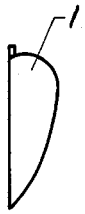
Figure 4:
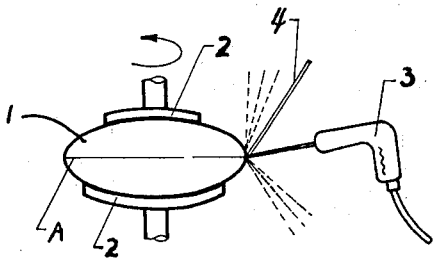
FIG. 4 is a schematic view showing two half-pieces of a pendant being held together and welded with a silver-welding gun in accordance with this invention.

In the initial steps of this method of making pendants, copper plate of 0.4–0.6 mm thickness is cut and formed by pressing as a half-piece 1. Two half-pieces constitute a pendant as shown in FIG. 3, and each half-piece is provided with a hanging ring (1*a*).

In a further step, two half-pieces (1) are held tightly together with a clamp 2, and then are turned around at a slow speed. A silver-welding gun 3, manuplated by a worker or an automatic robot, slowly moves along the jointing line(A) and simultaneously melts a silver alloy welding rod 4, which melted salder flows along the jointing line(A) and fills up the gap in the jointing line(A) and finally hardens. When this welding process is finished, the two-pieces are welded together to make a half finished pendant with a hollow interior but without any holes.

The silver alloy welding rod 4 mentioned above is a kind of pure alloy of silver and copper originated by the inventor, and does not need welding paste that would produce harmful poisonous gas in the process of welding, and thus can reduce occupational diseases, or environmental hazards. The metal proportion in this alloy is 60–80 percent silver to 20–40 percent copper and this special formula is used in the method of this invention.

Figure 5:
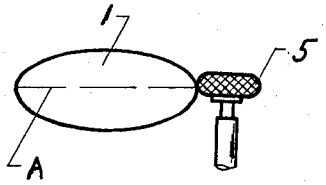
FIG. 5 is a schematic view showing a pendant being ground in accordance with this invention.

Next, this half-finished pendant, as shown in FIG. 5 is ground with a grinder 5 to remove welding rubbish on the jointing line(A). The grinder is stationary and has disk grindstone turning at a definite speed with the pendant being ground moved with respect to the grinder.

Figure 6:
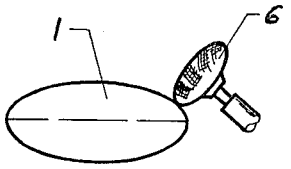
FIG. 6 is a schematic view showing a pendant being polished in accordance with this invention.

After the grinding is finished, the pendant is polished by a buff-polishing machine 6, as shown in FIG. 6, and the surface treatment of this pendant is thereby accomplished preparatory to electroplating, the last part of this method.

Figure 7:
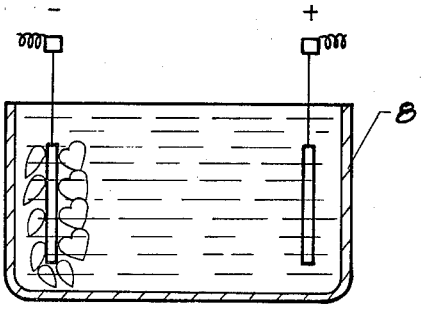
FIG. 7 is a schematic view showing pendants in the process of electroplating in accordance with this invention.
Figure 8:
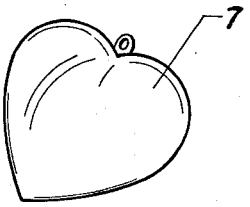
FIG. 8 is a perspective view of a pendant completely finished in accordance with this invention.

In the last electroplating step, the pendants 7 already ground and polished are immersed in an electroplating tub 8 in order to be gilded or coated with silver, shown in FIG. 7. After electroplating, the pendants are very bright and smooth and retain their beauty for a long time.

I claim:

1. A method for making a hollow pendant of copper plate comprising cutting workpieces of the desired configuration for the pendant from copper plate, press-forming said workpieces into half-pieces having the desired form for a half-piece of the pendant, clamping two of said half-pieces tightly together at their common surface to be joined, slowly rotating said clamped half-pieces and simultaneously welding said surface together with silver alloy welding rod to join said half-pieces into a pendant, grinding said welded joint, polishing said pendant, and electroplating the surface of said pendant with the desired material to make the finished product.

2. The method as claimed in claim 1, wherein said silver alloy welding rod comprises a rod having the proportion of 60–80 percent silver to 20–40 percent copper.

* * * * *